US009228421B2

(12) United States Patent
Kent et al.

(10) Patent No.: US 9,228,421 B2
(45) Date of Patent: Jan. 5, 2016

(54) INSERT ASSEMBLY FOR DOWNHOLE PERFORATING APPARATUS

(75) Inventors: Michael Kent, Beaumont (CA); David Donnelly, Edmonton (CA)

(73) Assignee: Ten K Energy Services Ltd., Beaumont, Alberta ( * ) Notice: Subject to any disclaimer, the term of this patent is extended or adjusted under 35 U.S.C. 154(b) by 560 days.

(21) Appl. No.: 13/562,310

(22) Filed: Jul. 30, 2012

(65) Prior Publication Data

US 2014/0231064 A1 Aug. 21, 2014

(51) Int. Cl.

| | |
|---|---|
| ***E21B 43/114*** | (2006.01) |
| ***E21B 43/26*** | (2006.01) |
| ***E21B 34/06*** | (2006.01) |

(52) U.S. Cl.

CPC ..... *E21B 43/114* (2013.01); *E21B 34/063* (2013.01); *E21B 43/26* (2013.01)

(58) Field of Classification Search

CPC ... E21B 43/112; E21B 43/114; E21B 43/119; E21B 43/26; E21B 34/063

USPC ..... 166/100, 317, 308.1, 376, 222, 223, 166/177.5, 281, 55–55.2; 137/382; 138/92

See application file for complete search history.

(56) References Cited

U.S. PATENT DOCUMENTS

| | | | | | |
|---|---|---|---|---|---|
| 2,186,323 | A | * | 1/1940 | Brown | 166/264 |
| 2,191,750 | A | * | 2/1940 | Brown | 166/63 |
| 2,381,929 | A | * | 8/1945 | Schlumberger | 166/55.1 |
| 2,775,304 | A | * | 12/1956 | Zandmer | 166/100 |
| 2,855,049 | A | * | 10/1958 | Zandmer | 166/100 |
| 2,903,072 | A | * | 9/1959 | Mennecier | 166/100 |
| 2,913,959 | A | * | 11/1959 | Mohaupt | 175/4.59 |
| 2,953,971 | A | * | 9/1960 | Porter | 175/4.58 |
| 3,057,405 | A | * | 10/1962 | Mallinger | 166/288 |
| 3,245,472 | A | * | 4/1966 | Zandmer | 166/100 |
| 3,326,291 | A | * | 6/1967 | Zandmer | 166/100 |
| 5,224,556 | A | * | 7/1993 | Wilson et al. | 175/4.53 |
| 5,425,424 | A | * | 6/1995 | Reinhardt et al. | 166/291 |
| 5,511,617 | A | * | 4/1996 | Snider et al. | 166/291 |
| 5,765,637 | A | * | 6/1998 | Dietle et al. | 166/55 |
| 6,095,247 | A | * | 8/2000 | Streich et al. | 166/299 |

(Continued)

FOREIGN PATENT DOCUMENTS

| | | |
|---|---|---|
| CA | 2441757 A1 | 10/2002 |
| CA | 2692377 A1 | 9/2010 |

OTHER PUBLICATIONS

Dictionary definition of "Chamber", accessed Jul. 27, 2015 via thefreedictionary.com.*

(Continued)

*Primary Examiner* — Blake Michener
(74) *Attorney, Agent, or Firm* — Field LLP

(57) ABSTRACT

An insert for perforating a subterranean formation sealingly engages a port in a production casing run into a wellbore intersecting the formation. The insert has a core where in a first mode it prevents fluid passage through the insert, and a second mode where the core disengages from the insert upon a treatment fluid reaching a threshold pressure in the casing, and ejects from the insert as a projectile to initiate and contribute to the fracture and stimulation of the formation by the pressurized treatment fluid exiting the port. The insert has a chamber which is filled with a gel that prevents wellbore cement from setting and is covered by a perforated debris shield that permits the equalization of pressure between the chamber and the annulus between the casing and wellbore.

15 Claims, 22 Drawing Sheets

(56) References Cited

U.S. PATENT DOCUMENTS

Figure 1A:
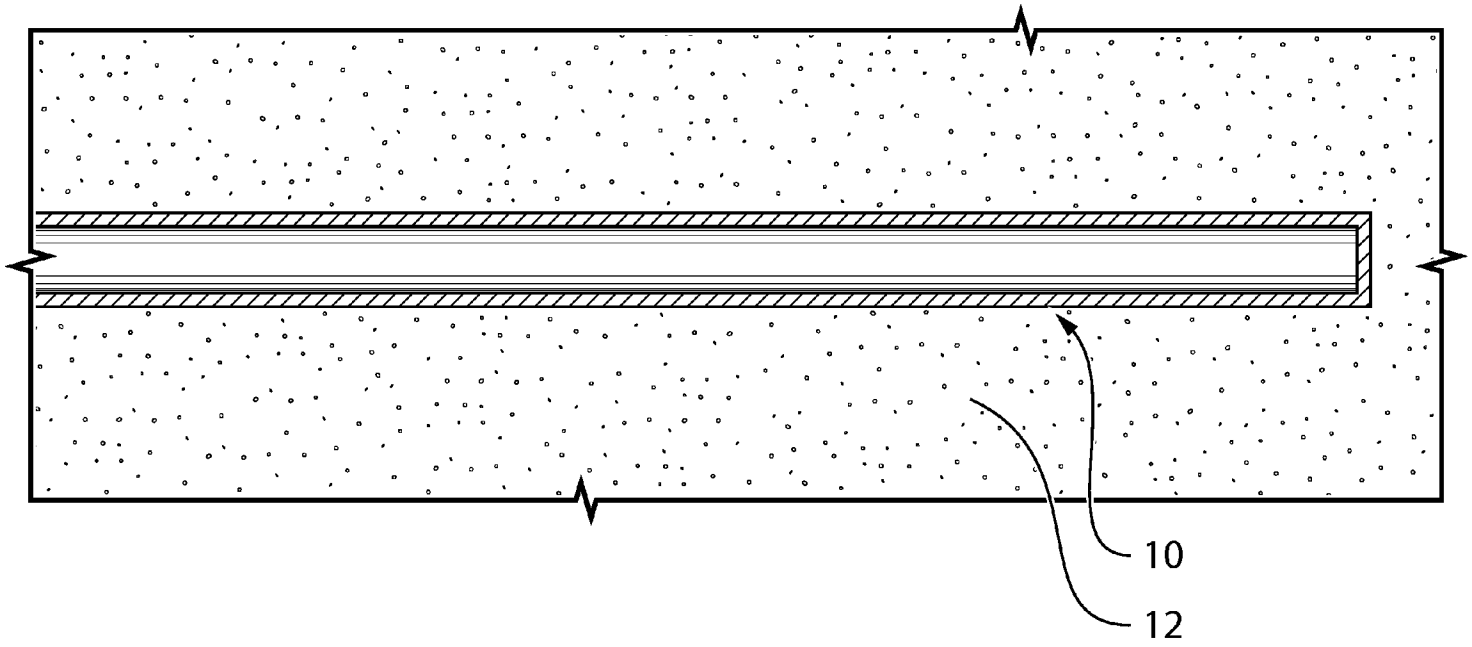

| | | | | |
|---|---|---|---|---|
| 6,457,528 | B1 * | 10/2002 | Staudt | 166/363 |
| 6,675,898 | B2 * | 1/2004 | Staudt | 166/363 |
| 7,775,277 | B2 * | 8/2010 | Johnson | 166/278 |
| 8,079,416 | B2 * | 12/2011 | Parker | 166/285 |
| 8,127,858 | B2 * | 3/2012 | Lynde et al. | 166/383 |
| 8,297,349 | B2 * | 10/2012 | Xu | 166/100 |
| 8,297,364 | B2 * | 10/2012 | Agrawal et al. | 166/376 |
| 8,863,850 | B2 * | 10/2014 | Sherman et al. | 166/376 |
| 2007/0017675 | A1 * | 1/2007 | Hammami et al. | 166/278 |
| 2007/0272411 | A1 * | 11/2007 | Lopez De Cardenas et al. | 166/305.1 |
| 2011/0155377 | A1 * | 6/2011 | Laun | 166/308.1 |
| 2011/0315380 | A1 * | 12/2011 | Sherman | 166/285 |
| 2012/0037366 | A1 * | 2/2012 | Sherman | 166/297 |
| 2014/0251612 | A1 * | 9/2014 | Powers | 166/281 |

OTHER PUBLICATIONS

Affidavit of Vitally Arabsky, dated May, 31, 2013.

* cited by examiner 28
32
38
40
34
44
34
30
42
21
24
28
29
28
x
26

32
26
30
23
20
22
24
22
32
28
26
20

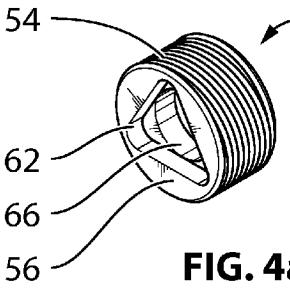
FIG. 4a
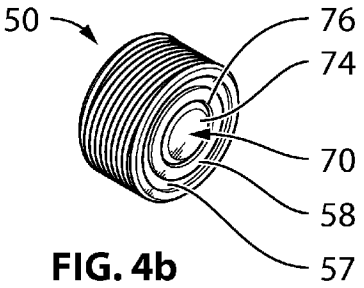
FIG. 4b
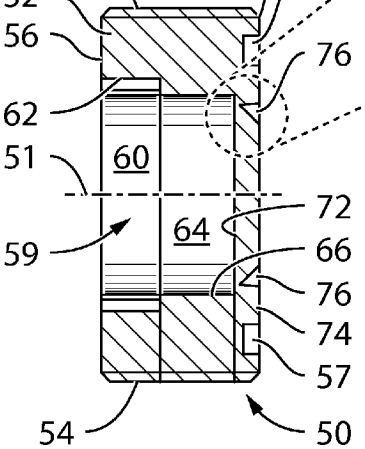
FIG. 4c
FIG. 4d
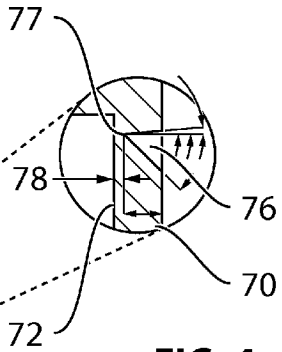
FIG. 4e 50
26
20
22

60
59
90
80
50
57
68
84
64
23
82
44
38
56
58
36
70
42

50
50

20
26
23

INSERT ASSEMBLY FOR DOWNHOLE PERFORATING APPARATUS

FIELD OF THE INVENTION

The present invention relates to hydraulic or mechanical completion equipment for wellbores in general and in particular relates to a tool for fracturing and stimulating subterranean formations bearing a target fluid such as oil or gas.

BACKGROUND OF THE INVENTION

If a hydrocarbon bearing subterranean formation either lacks permeability or flow capacity for cost effective recovery of the hydrocarbon, then it is common practice to use hydraulic fracturing of the formation to increase the flow of the hydrocarbon, typically oil or gas. This method of stimulation creates flow channels for the hydrocarbon to escape the formation into a wellbore penetrating the formation, to maintain well production.

The wellbore typically consists of a metal pipe, commonly known as a "casing", "production casing", "wellbore liner" or "completion string", which is tripped into the original (uncased) borehole and is cemented into place. Fracturing of the formation occurs when a treatment fluid is pumped under high pressure into the casing, usually via a tubular treatment string run inside the casing, and is ejected through holes in the casing, and through the cement, into the formation to cause fractures in its strata. The treatment fluid carries a proppant, such as sand or the like, which penetrates the fractures to hold them open after the treatment fluid pressure is released, and can include additives such as acids.

A current method of sealing the casing hole before fracturing begins employs a "burstable disk", also known as a "rupture disk" or "burst disk". The disk is formed either by machining a wall of the casing to produce a thin portion that serves as the burstable disk, or it may be a thin sheet of material placed over the casing hole. The disk has a rupture pressure threshold, and is located to block the flow of fluids through the hole while intact. Once the treatment fluid pressure reaches this threshold, the disk bursts to allow the treatment fluid to escape through the casing hole and fracture the formation strata.

A disadvantage of a burstable disk is that it merely acts as a non-reclosing pressure relief seal. The disk itself is not designed to participate in or enhance the fracturing process being performed by the pressurized fracturing fluid. A disk is in effect a membrane that either holds back a fluid, or ruptures to release the fluid. A ruptured disk is either non-fragmenting, meaning that the ruptured pieces of the disk remain attached to the perimeter of the disk, or is fragmenting, meaning that the membrane breaks into pieces which are lost.

Another disadvantage of a burstable disk is that a barrier, or cap, must be provided intermediate the disk and the wellbore annulus to protect the disk from the pressures present in the annulus. Since a differential pressure exists between the annulus and the casing, the barrier prevents pressure outside the casing from bursting the burstable disk inwardly during placement, cementing or the like. The chamber formed between the barrier and the disk must be thoroughly sealed and kept at or near atmospheric pressure until the disk is burst. If the seal is compromised and the chamber pressure changes, then the disk's rupture pressure threshold will change and could result in premature failure or untimely bursting of the disk. The disk could also malfunction should cement penetrate the chamber.

What is therefore desired is a novel downhole apparatus and insert assembly having a core which overcomes the limitations and disadvantages of the existing tools. Preferably, it should provide a means of sealing a port in a completion string from fluid flow therethrough when the insert is intact. When a threshold fluid pressure is reached, the core should disengage from the insert to provide a projectile that should impact the strata of the target formation to enhance the fracing process. The insert assembly should avoid the need for a barrier that is sealed from the annulus, but rather provide a ported debris shield that should allow annulus pressures to reach the core. The shield should form a chamber in the insert to retain a gel to obstruct entry of cement thereinto and to prevent setting of the cement which it contacts.

SUMMARY OF THE PRESENT INVENTION

According to the present invention, there is provided in one aspect an assembly for perforating a subterranean formation for use in a tubular member having at least one port, the tubular member being insertable in a wellbore intersecting the subterranean formation and adapted to receive a treatment fluid under pressure, the assembly comprising:

an insert having a body for sealing engagement with the port, the body including a core having a first mode wherein the core prevents fluid passage through the body and a second mode wherein the core disengages from the body upon the treatment fluid reaching a threshold pressure and ejects from the body as a projectile to contribute to the fracture of the formation by the pressurized treatment fluid exiting the port.

In another aspect the invention provides a downhole apparatus for perforating a subterranean formation comprising a tubular member insertable in a wellbore intersecting the subterranean formation for receiving a treatment fluid under pressure;

at least one port in the tubular member; and, an insert sealingly engaged with the port, the insert including a core having a first mode wherein the core prevents fluid passage through the insert and a second mode wherein the core disengages from the insert upon the treatment fluid reaching a threshold pressure and ejects from the insert as a projectile to contribute to the fracture of the formation by the pressurized treatment fluid exiting the port.

In a further aspect the invention provides a debris shield spaced from the core wherein the shield and insert define a chamber therewithin.

In a further aspect the shield is perforated to provide a means of equalizing pressure between the chamber and an annulus formed between the tubular member and the wellbore.

In a further aspect the chamber includes a substance for resisting entry of a wellbore fluid thereinto through the hole.

BRIEF DESCRIPTION OF THE DRAWING FIGURES

Figure 1B:
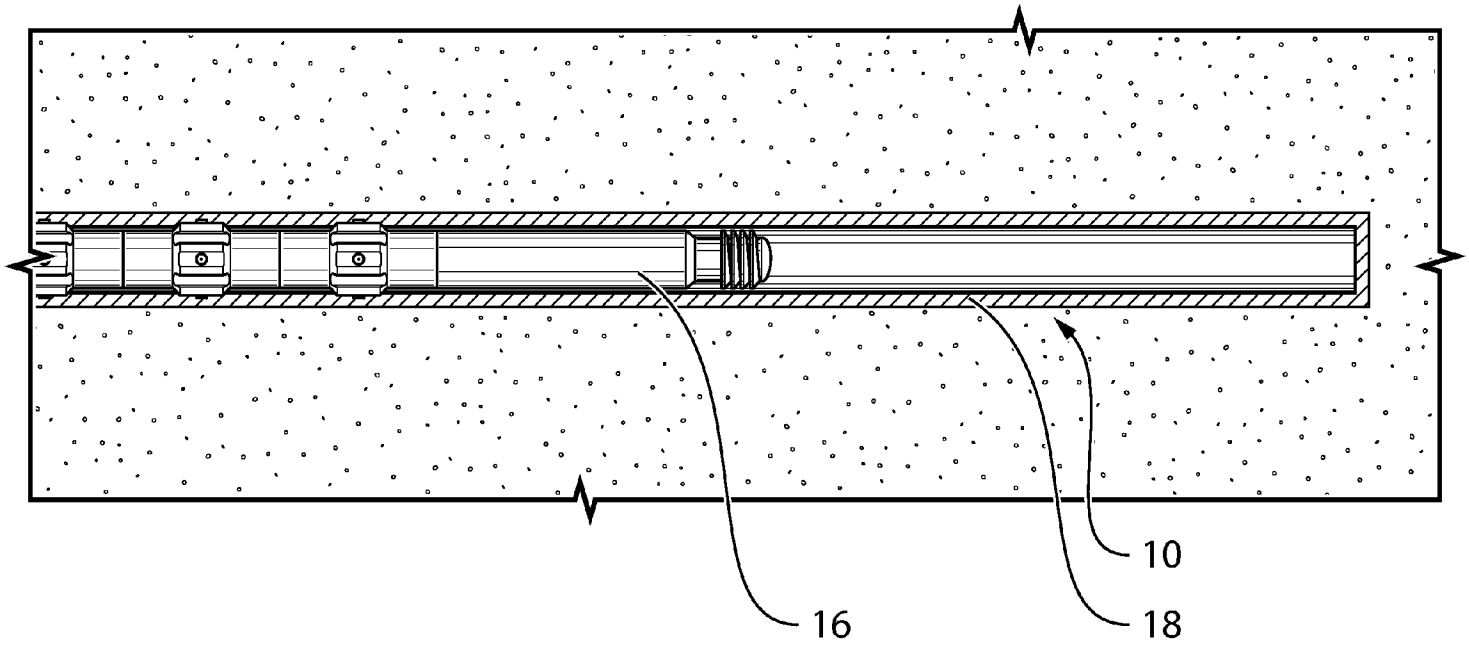
Figure 1C:
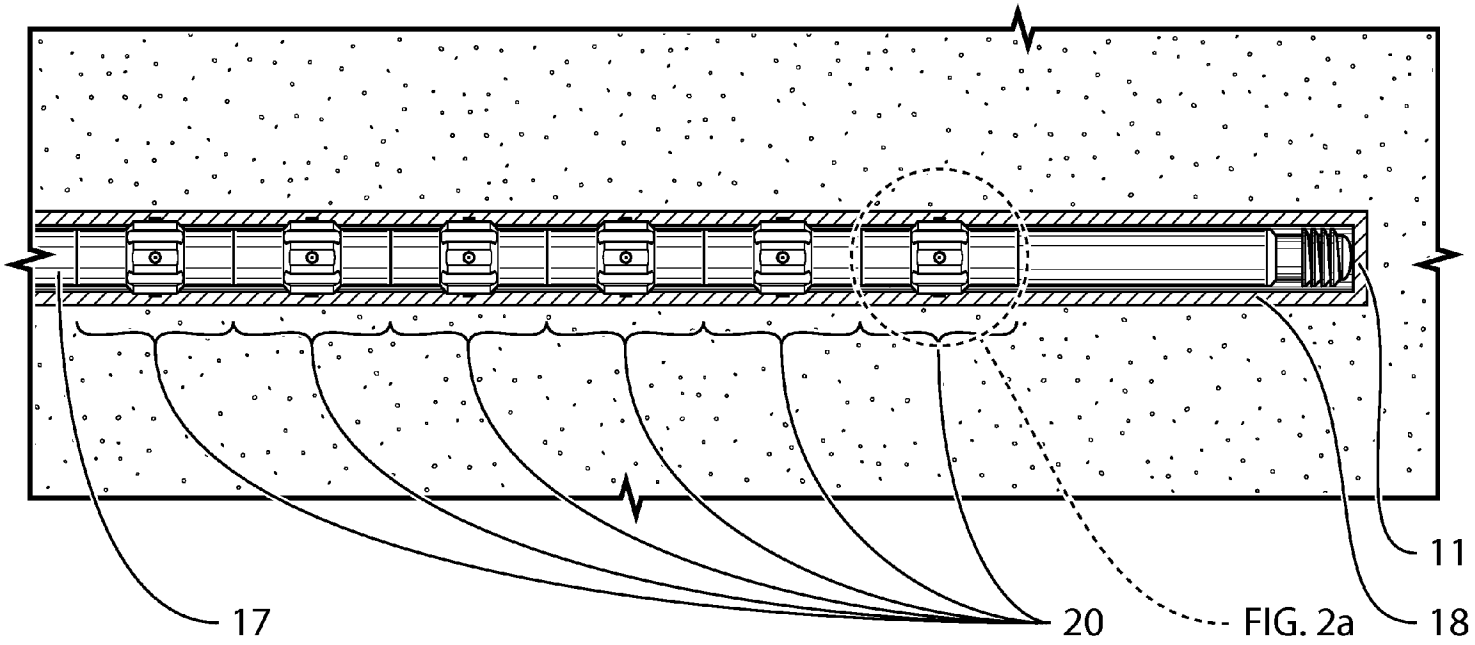
Figure 1D:
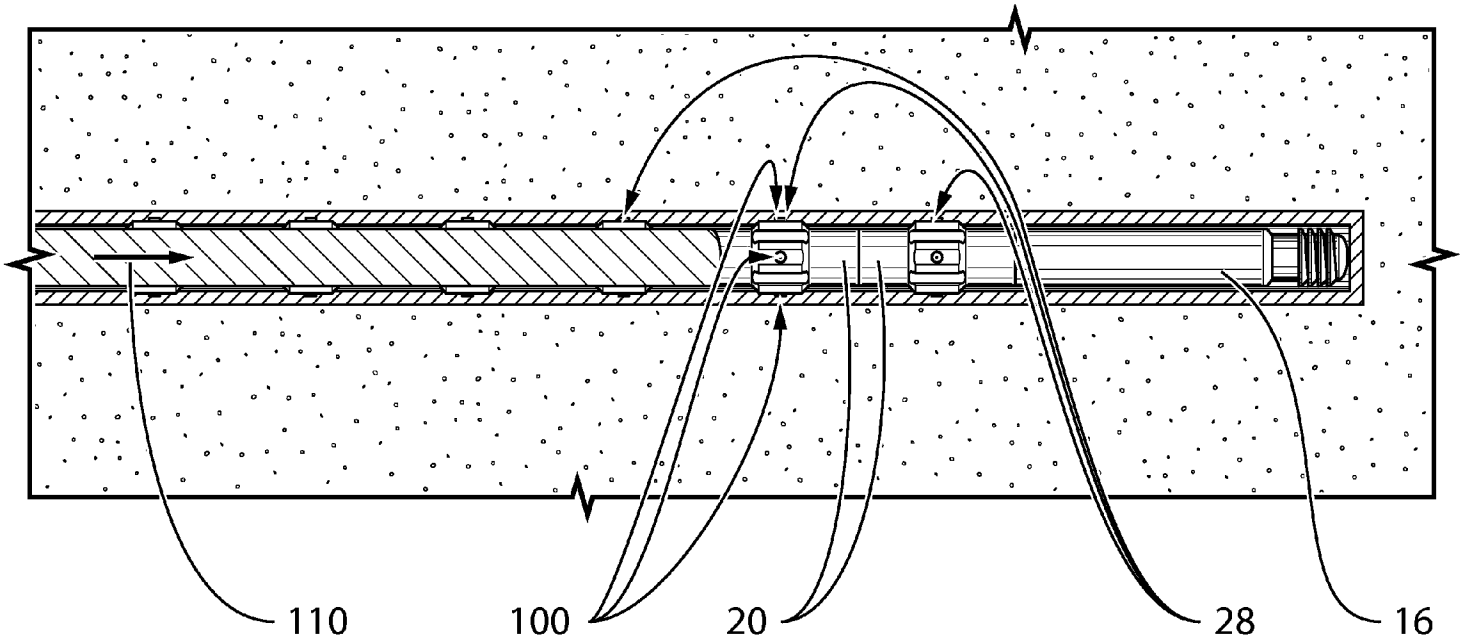
Figure 1E:
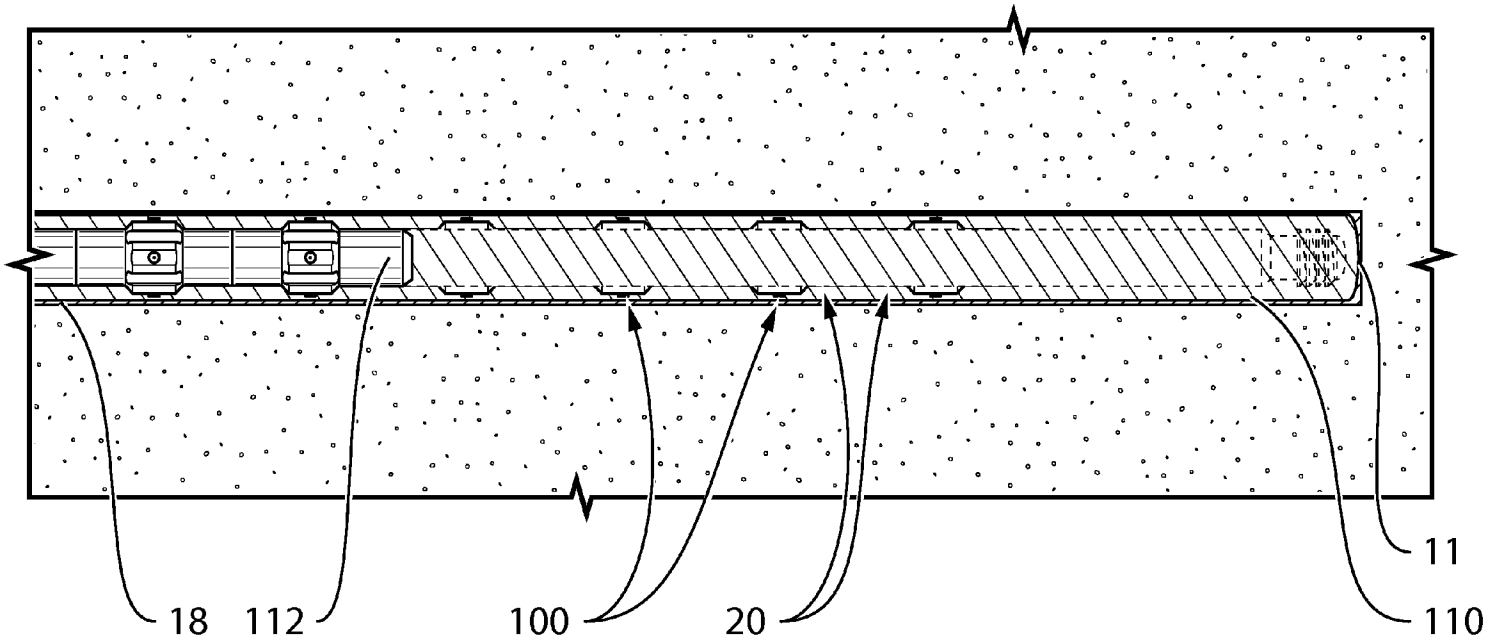
Figure 2A:
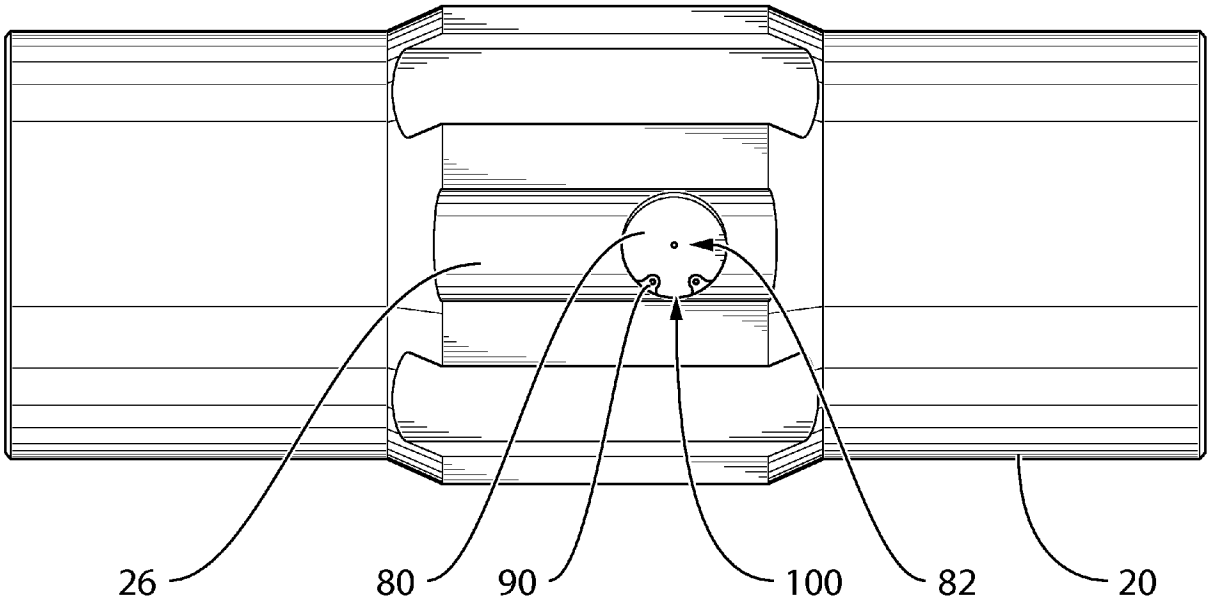
Figure 2B:
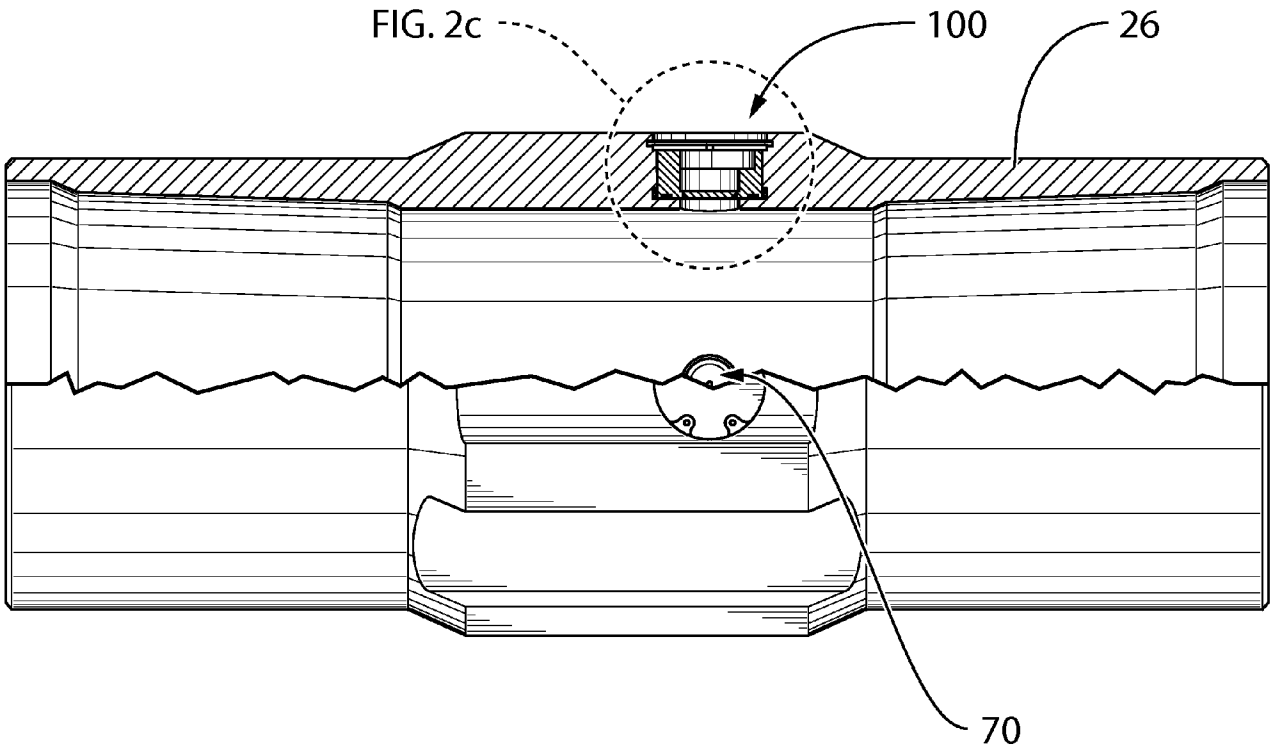

Embodiments of the invention will now be described, by way of example only, with reference to the accompanying drawings, wherein:

FIGS. 1*a* to 1*m* illustrate in cross-section an environment and a method of fracing using a treatment string within a production casing according to an embodiment of the present invention;

FIG. 2*a* is an enlarged view of the encircled area of the production casing indicated by the numeral 2*a* in FIG. 1*c* showing, in isolation, a collar housing an insert assembly according to an embodiment of the present invention;

FIG. 2*b* is a partially transparent view of the collar of FIG. 2*a;*

Figure 2C:
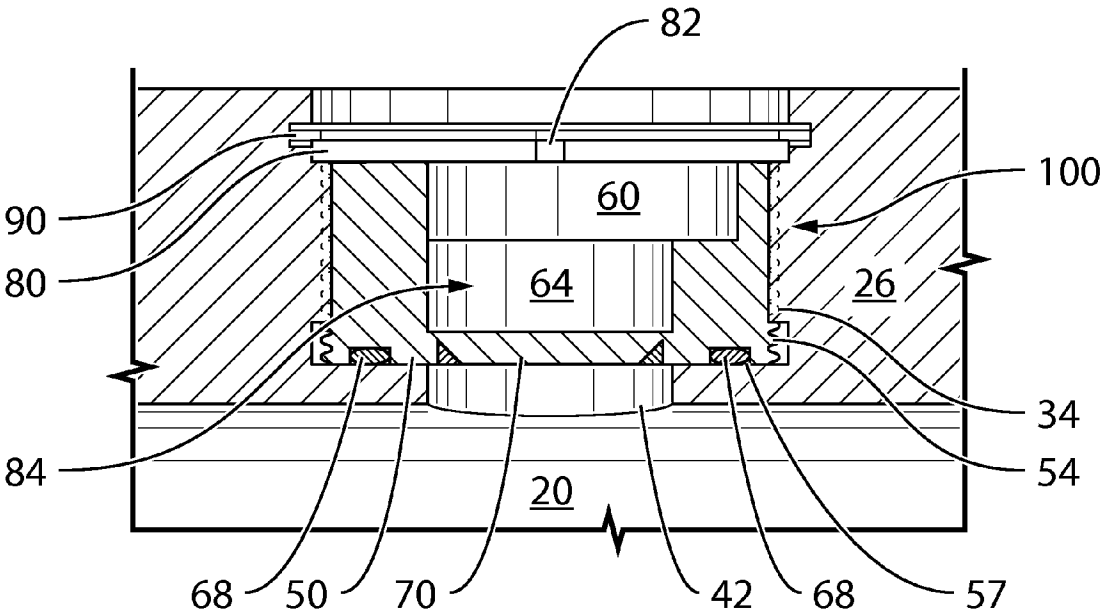
Figures 3A, 3B, 3C:
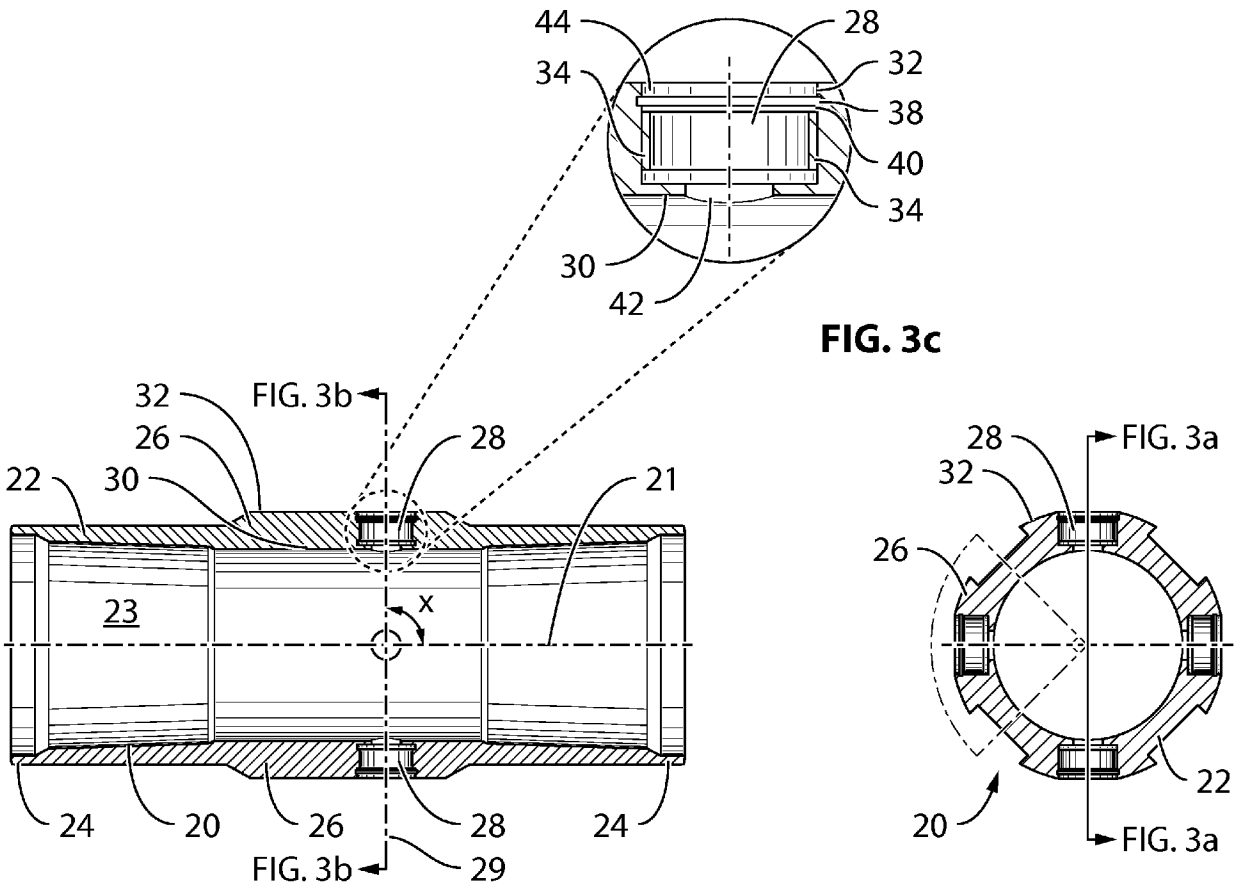

FIG. 2*c* is an enlarged view of the circled area indicated by numeral 2*c* in FIG. 2*b* showing in greater detail an insert assembly inserted in a port of the collar;

FIG. 3*a* is a cross-sectional view along the line 3*a*-3*a* of FIG. 2*b* showing the collar without insert assemblies;

FIG. 3*b* is a cross-sectional view along the line 3*b*-3*b* of FIG. 3*a;*

FIG. 3*c* is an enlarged view of the circled area indicated by numeral 3*c* in FIG. 3*a* showing in greater detail a port of the collar;

FIG. 4*a* is an isometric view from the front of the insert of FIG. 2*c;*

FIG. 4*b* is an opposed isometric view, from the rear, of the insert of FIG. 4*a;*

FIG. 4*c* is a front view of the insert, namely from the left side of FIG. 4*a;*

FIG. 4*d* is a cross-sectional view along the line 4*d*-4*d* of FIG. 4*c;*

Figure 5:
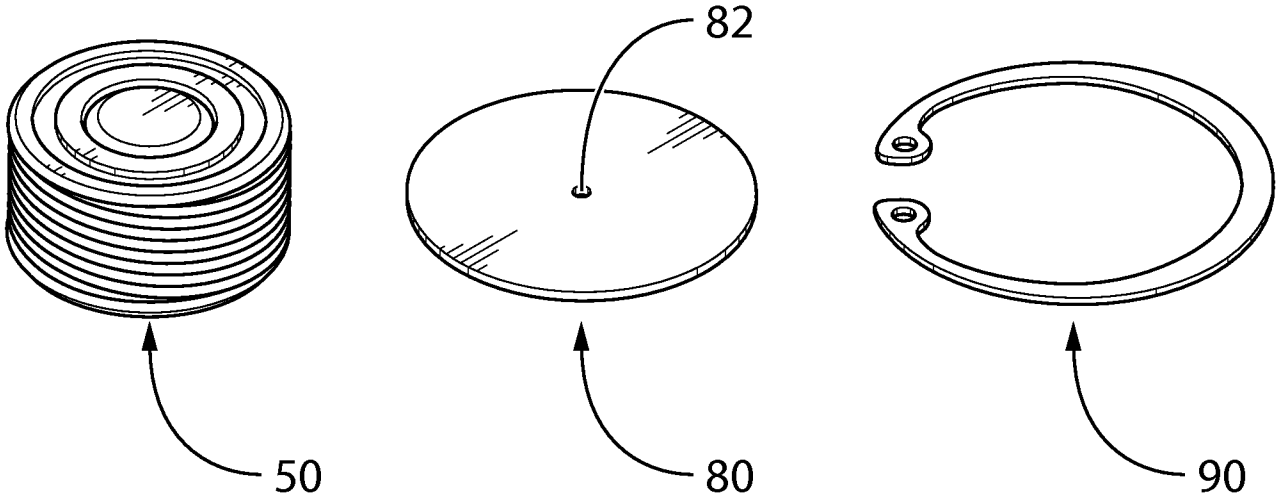

FIG. 4*e* is an enlarged view of the circled area indicated by numeral 4*e* in FIG. 4*d* showing in greater detail a portion of a core formed by the insert;

FIG. 5 shows in perspective some disassembled components of the insert assembly of FIG. 2*c;*

Figures 6A, 6B, 6C:
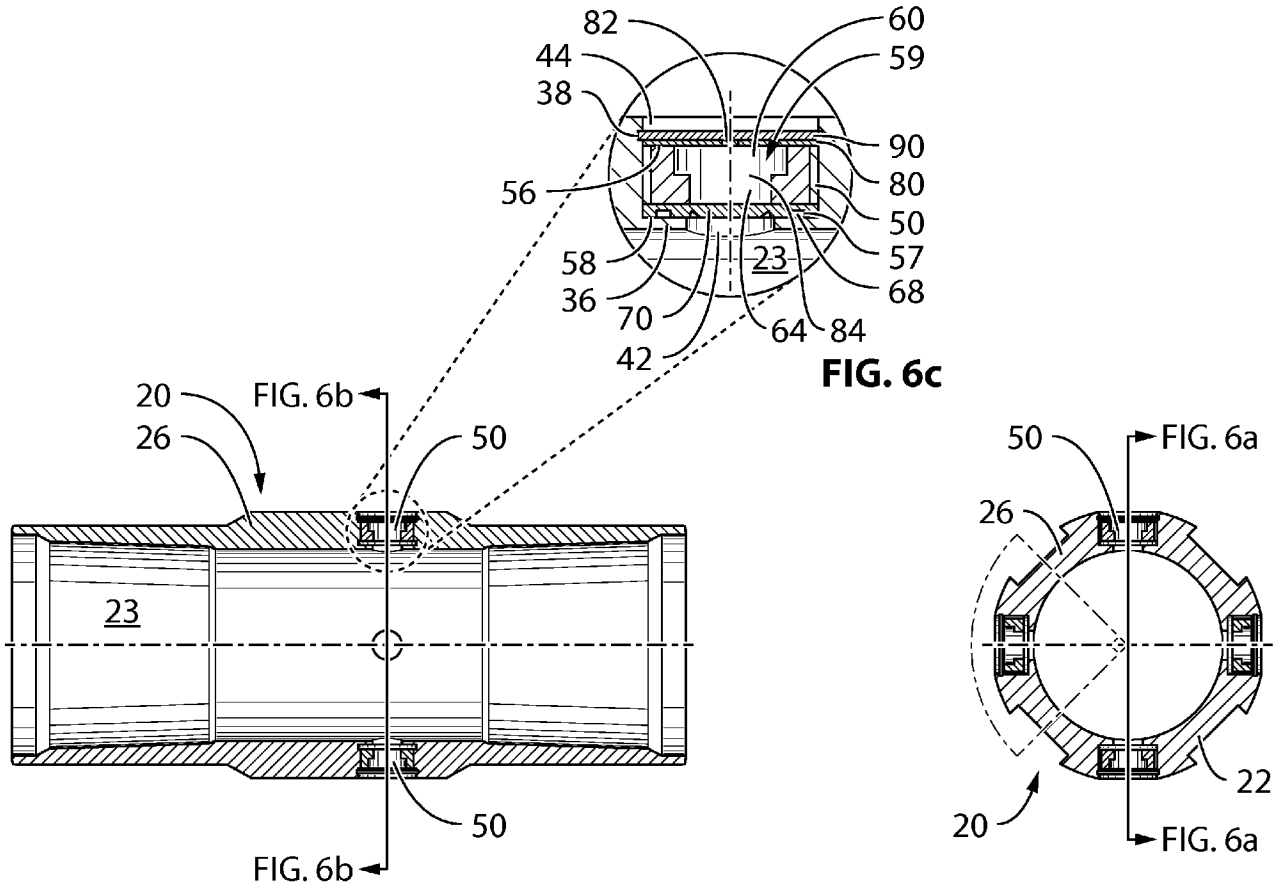
Figure 7B:
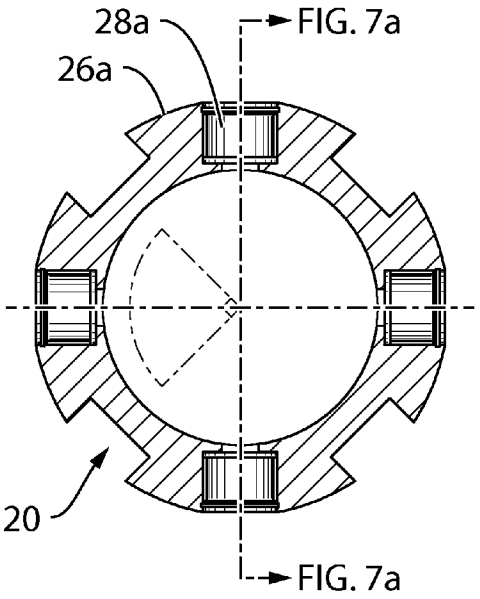
Figure 7A:
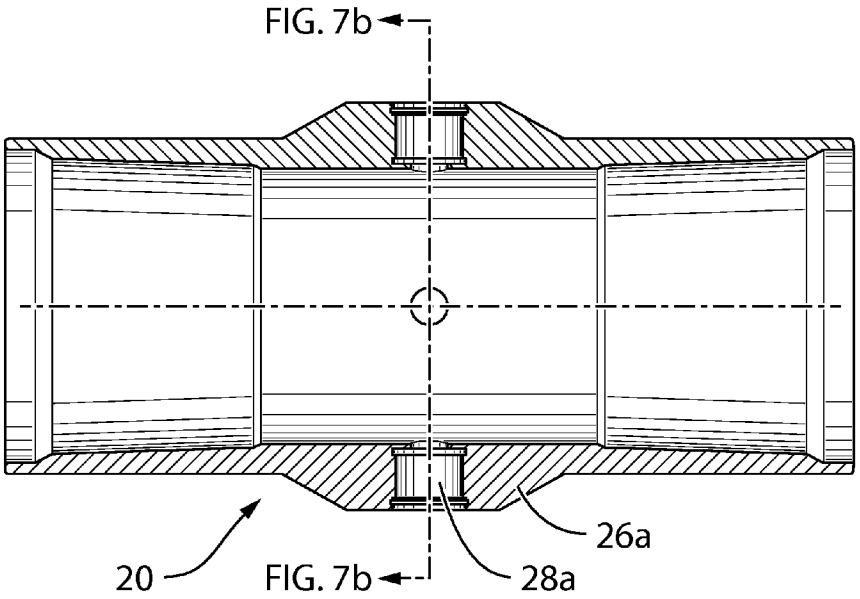
Figure 8:
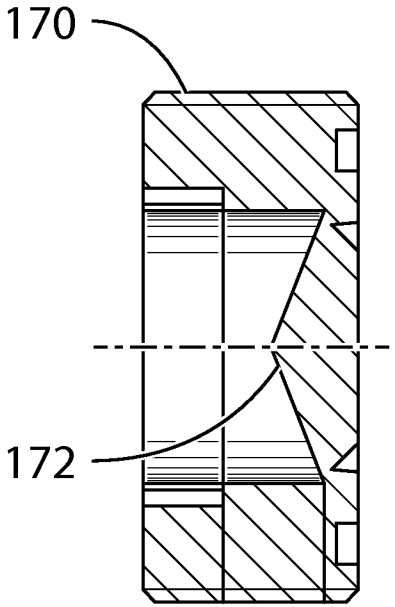

FIGS. 6*a* to 6*c* correspond to FIGS. 3*a* to 3*c*, respectively, but show the collar with the insert assemblies mounted in the ports;

FIGS. 7*a* and 7*b* show an alternate embodiment of the collar of FIGS. 3*a* and 3*b*, respectively, having deeper ports and stabilizers; and, FIG. 8 shows in cross-section an alternate embodiment of the insert of FIG. 4*d* having a bullet-like cone shaped core.

DESCRIPTION OF PREFERRED EMBODIMENTS

Although the device and method of the present invention may be employed for various types of wells and completion procedures, such as with open hole packers in an uncemented well, a horizontal cemented well will be referred to herein for illustrative purposes. A part of the method is first set out in FIGS. 1*a* to 1*c* which show a horizontal wellbore 10, or borehole, drilled into a subterranean formation 12 bearing a hydrocarbon, such as oil or gas, or other desired target fluid 14 (shown in FIG. 1*m*). The wellbore wall is initially unlined, or uncased (FIG. 1*a*).

A production casing 16, also known as a completion string or wellbore liner, is inserted, or tripped, into the wellbore 10 to its terminus 11. An annular space 18, or annulus, is formed between the casing 16 and the wall of the wellbore 10. The production casing 16 may be considered a tubular member capable of flowing or communicating fluids under pressure along the wellbore.

Collars are employed to join segments 17 of the production casing. For illustrative purposes, FIGS. 1*b* and 1*c* show a leading end of the production casing having six sequentially joined tubular collars 20. However, it will be understood that at least one pipe segment 17 would typically be located between the collars to mate appropriate thread patterns. Alternately, if no pipe segments are to be employed and the collars are to be joined directly, then the collars would require cooperative thread patterns, or alternate joining means, but this is not preferred.

FIGS. 3*a* to 3*c* show in greater detail a downhole apparatus defined by a collar 20 having an elongate tubular body 22 with threaded ends 24. Intermediate the ends 24 in a central area of the body 22 are four circumferentially spaced fins 26, or stabilizers, extending radially outwardly which act to centralize the collar, and thus the production casing, within the wellbore in a known manner. Therefore, the annulus 18 is reduced, or minimized, at each fin compared to other locations along the collar and production segments 17. One or more of the fins, but preferrably each fin, has at least one port 28 extending therethrough from an inner surface 30 to an outer surface 32, and is "phased" or oriented so that the port's centreline 29 is perpendicular (i.e. angle X=90 degrees) to the collar's centreline 21. This group of four equally spaced ports 28 is located in the same transverse plane as shown in FIG. 3*b*, although this invention is not limited to that one particular configuration. More ports may also be provided in each fin, but such configuration is not illustrated here. Also, the port's "phasing" orientation may be altered to suit particular fracing requirements, by machining the port at an inclination to the collar so that the angle X is less than 90 degrees, such as 60 degrees or less.

Each port 28, shown in greater detail in FIG. 3*c*, is configured to receive an insert assembly of this invention described below. The port has a treaded central portion 34, below which is a circumferential inwardly extending lip 36 formed contiguously with the collar's inner surface 30, and results in an inner opening 42 of smaller diameter than the port's outer opening 44 at the fin's outer surface 32. The treaded portion 34 terminates short of the outer surface 32 to provide for a circumferential notch 38 of larger diameter than the port. Intermediate the notch 38 and the treaded portion 34 is a smooth, unthreaded portion of the port that effectively forms a slot 40.

Components of the insert assembly to be inserted into each of the ports 28 include an insert 50, a lid 80 (defining a debris shield that guards the port and insert from debris external to the collar) and a resilient c-clamp 90, shown individually in FIG. 5. The insert 50 is an important element of the assembly, and described in greater detail with reference to FIGS. 4*a* to 4*e*. The insert's cylindrical hollow body 52 has an outer surface 54 threaded to mate the threaded portion 34 of a port. The left side of the insert (as viewed in FIG. 4*d*) is formed by a generally planar exterior surface 56, and the opposed right side is formed by a generally planar interior surface 58. A circumferential channel 57 is inset into the interior surface 58, proximate the threaded outer surface 54, for housing a seal (68 in FIGS. 2*c* and 6*c*) that functions to prevent leakage between the collar's interior 23 and the wellbore's annulus 18 along the insert's threaded interface with the port.

The insert body's hollow interior forms a chamber 59 defined by two adjacent co-axial sub-chamber sections 60, 64. The first sub-chamber 60 extends a given depth inwardly from the insert's exterior surface 56. The depth and shape of the first sub-chamber's smooth inner surface 62 is chosen to removably receive a tool for threading the insert into a port. In the embodiment shown the chosen shape is triangular with rounded corners, and the sub-chamber depth is roughly ⅓ of the insert's total depth (as measured from the exterior to interior surfaces 56, 58), namely about 0.187 inch (approximately 4.68 mm) out of a total depth of about 0.50 inch (approximately 12.20 mm), to accept a like shaped tool. The shape is rather unusual, and makes unauthorized removal of the insert from the port difficult.

The second sub-chamber section 64 has a smooth circular inner surface 66, with a diameter such that it tangentially meets each of the first sub-chamber's triangular inner surface 62, as best seen in FIG. 4*c*. The second sub-chamber 64 may be made circumferentially smaller relative to the first sub-chamber 60, or perhaps even somewhat larger, but this is not preferred as it may affect the manufacturing efficiency and performance of the insert. In the embodiment shown the second sub-chamber's diameter is about 0.625 inch (approximately 15.88 mm) measure across the insert's centerline 51. The depth of the second sub-chamber 64 extends from its juncture with the first sub-chamber to the insert's core portion 70, stopping short of the insert's interior surface 58. In the embodiment shown in FIG. 4*d*, the second sub-chamber depth is roughly ½ of the insert's total depth, namely about 0.235 inch (approximately 5.97 mm).

Adjacent the second sub-chamber 64 is the circular core 70 formed integrally with the insert's body 52. The core's generally planer outer wall 72 faces the second sub-chamber 64, and an opposed planer inner wall 74 is co-planar with, and forms part of, the insert's interior surface 58. The core's inner wall 74 is disk-shaped as defined by a groove 76 extending circumferentially about the insert's centerline 51. As shown in detail in FIG. 4*e*, the annular groove 76 is machined to a v-shaped profile and to a pre-set depth which results in a bridge portion 78 intermediate the apex 77 and the outer wall 72 that keeps the core joined with the body 52. The bridge portion 78 is slightly off-set radially inwardly from the second sub-chamber's inner surface 66, to ensure that the core is of lesser diameter than the chamber when the core passes therethrough as a projectile. In the embodiment shown, the apex 77 is at a diameter of about 0.56 inch (about 14.22 mm) about the insert centreline 51, which is less than the diameter of both the first and second sub-chambers 60, 64. The groove profile may take other suitable shapes, such as u-shape, but this is not preferred as the rupture location may be less defined.

In determining a threshold pressure at which the core 70 is expected to disengage from the surrounding insert body 52 as a projectile, it will be appreciated that consideration must be given to such criteria as the insert material, the depth of the bridge portion 78 and the configuration of the groove 76. For instance, in the FIGS. 4*a* to 4*e* configuration the core can be configured to disengage in a clean break from the insert body when the fluid pressure applied to the core's inner wall 74 reaches or exceeds about 2000 psi, or at another desired pressure.

Referring now to FIGS. 6*a* to 6*c* and 2*a* to 2*c*, insert assemblies are shown in their first mode inserted into each port of the collar 20, and the insertion sequence of an insert assembly is described with reference to the top port shown in FIG. 6*a*. The insert 50 is screwed into a given port 28 of the collar, using an insert tool (not shown) slotted into the first sub-chamber 60, until the insert's interior surface 58 sealingly engages the collar's lip 36 by pressing the seal 68 in the channel 57 against the lip. This locates and aligns the core 70 with the port's inner opening 42 into the collar, so that pressurized treatment fluid may later engage the core from within the production casing.

Upon removal of the tool, the insert 50 is in position and ready to receive a substance 84, preferably in fluid form, into the chamber 59 which will resist, or obstruct, entry of wellbore cement into the chamber. In a preferred embodiment the substance is a gel placed in the chamber by hand by an operator, but placement by other suitable means is also contemplated. Pre-placing at least some of the gel into the chamber prior to insertion of the insert into the collar is possible but not preferred for several reasons, as it could interfere with use of the insertion tool and it could attract and retain unwanted dirt or debris during insertion. The gel is formulated to prevent wellbore cement that it contacts from setting.

Once the chamber 59 is substantially filled with the gel 84, the lid 80 is inserted into the port 28 and pressed against the insert's exterior surface 56. The centre of the lid has at least one small hole 82 (about 0.063 inch, or about 1.59 mm diameter in the preferred embodiment; see also FIG. 5) which performs some important tasks. If the chamber has been over-filled with gel, then the excess gel can escape through the hole. This is particularly advantageous since any gel that exits the chamber through the hole 82 into the port (into the area immediately outside the shield) should prevent or interfere with setting of the wellbore cement in the vicinity of the port's mouth, thereby facilitating dislodging of the shield and providing a path of reduced resistance for the ejecting core to reach the subterranean formation. Also, the hole provides a means for equalizing pressure between the insert's chamber 59 and the annulus 18. Should any wellbore cement enter the chamber through the hole as pressures equalize, the gel should prevent the cement from setting therewithin, and thus avoid adverse effects on the performance of the insert. Once the lid 80 is in place, the snap ring 90 is inserted in a known manner into the port's circumferential notch 38 to retain the lid adjacent the insert at the port's slot 40.

When these insert assemblies have been placed in this manner into each of the ports of the collar, the collar is ready for insertion onto the production casing and/or into the wellbore. It will be appreciated that in this first mode the core 70 remains integral and intact as part of the insert 50, and as such the insert, including the core, seal their respective port 28 from any fluid passage therethrough. Hence, fluid is prevented from passing through the collar's inner opening 42, whether outwardly from the collar or inwardly from the annulus into the collar.

In a second mode, the core 70 disengages from the insert 50 when a treatment fluid, such as a fracing fluid, received inside the collar reaches the earlier noted threshold pressure. The threshold fluid pressure forces the core 70 to abruptly tear away from the insert, and the tear should generally track the periphery delineated by the v-shaped groove 76. In the FIG. 4*d* embodiment the disengaged core forms a generally disk, or saucer, shaped projectile in the form of a truncated cone (when viewed in cross-section as in FIG. 4*d*) with its leading or forward surface formed by the flat outer wall 72. This projectile should travel at high speed through the chamber 59 displacing the gel 84 and lid 80 which easily gives way, and in a trajectory away from the collar through the annulus and ultimately impacts the targeted subterranean formation, perforating it.

In an alternate embodiment shown in FIG. 8 the core 170 has a outer wall 172 that is cone-shaped so that the disengaged core has a bullet-shaped profile. This profile may provide advantageous perforating action in certain types of formations.

Figure 1F:
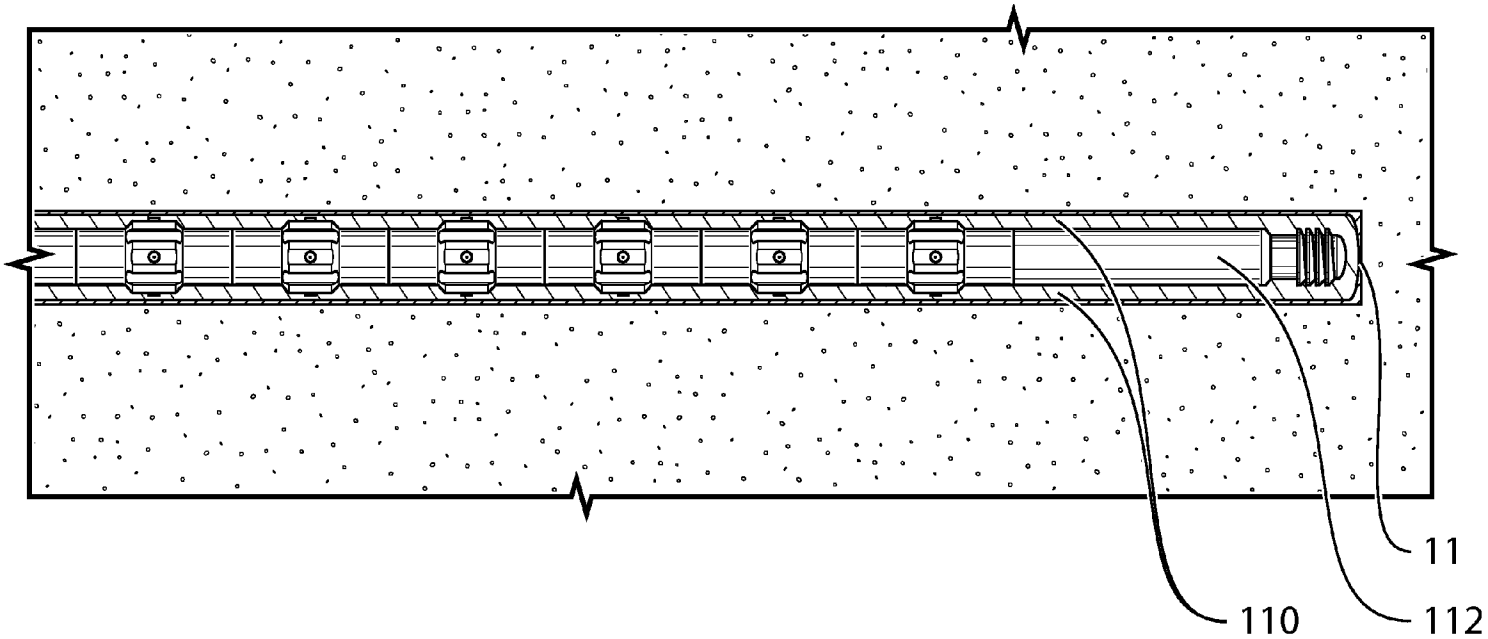

A method of sequential fluid fracturing of multiple intervals with a tubular member in a wellbore using the present insert assembly is now described with reference to FIGS. 1*a* to 1*m*. A first part of the method shown in FIGS. 1*a* to 1*c* has already been described, and so referring next to FIG. 1*d*, a cement 110 is shown being pumped down the production casing 16 and through each of the collars 20. The ports 28 of each collar were fitted with an insert assembly (indicated by 100 for ease of reference), which is understood to include an insert 50, lid 80, gel 84 and c-clamp 90, prior to being tripped into the wellbore to fluidly seal the ports. The cement continues to be pumped until it exits the production casing near the wellbore terminus 11 and begins to fill the annulus 18, including around the collars 20 (FIG. 1*e*) and their fins. If there is any space between an insert assembly 100 and the wellbore, and specifically between the perforated debris shield of the assembly and the wellbore, then the cement should infiltrate such space as well. As previously noted, the gel within the insert chamber acts to resist entry of the cement from the annulus through the debris shield into the chamber, but allows equalization of pressure between the annulus and chamber. Pumping of the cement is accomplished with a tubular pumping member 112 that pushes the cement down the production casing until it reaches the terminus 11, at which point the cement has been largely evacuated from the production casing into the annulus past each of the collars and insert assemblies (FIG. 1*f*). The operator can then slightly pressure-up the casing string to ensure all of the cement has been evacuated from the casing, sometimes referred to as "bumping up the wiper plug". Once the cement sets to securely bond the production casing in the wellbore, the well is ready to be completed.

Figure 1G:
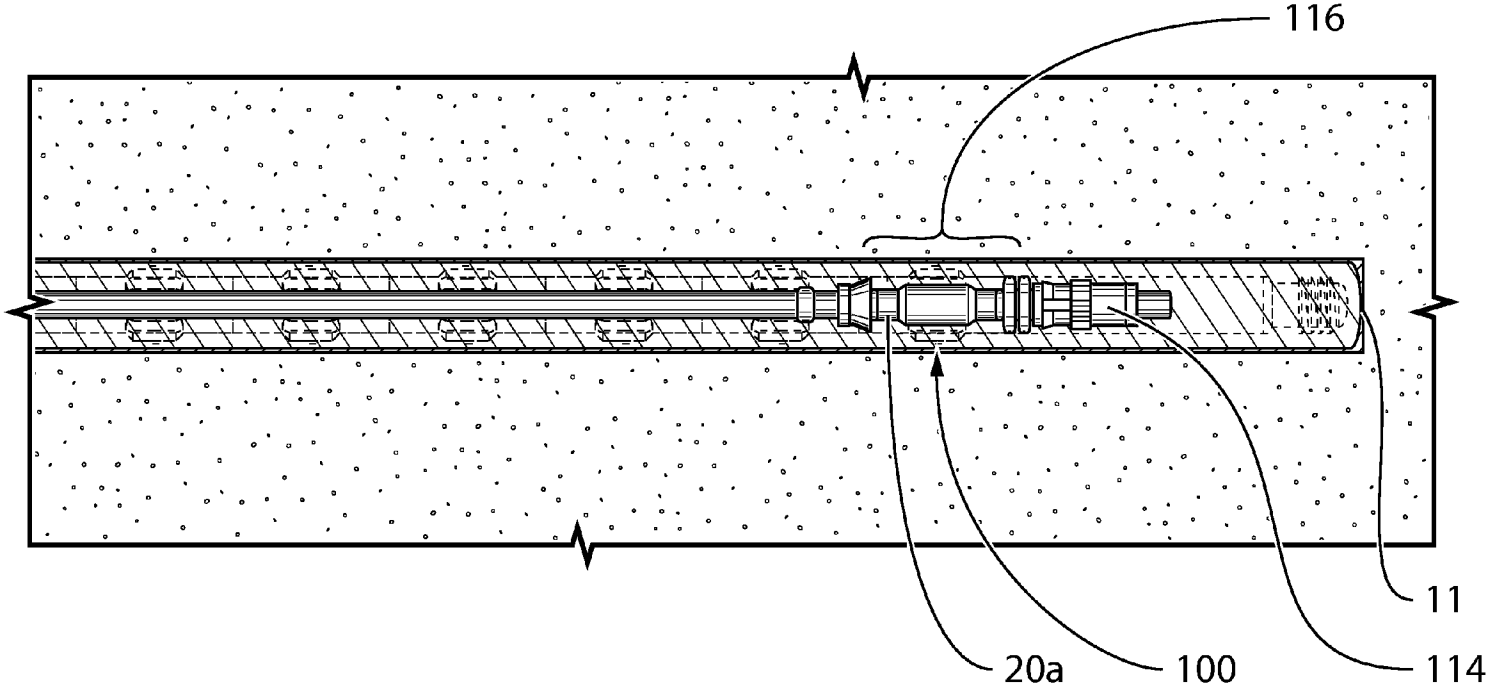
Figure 1H:
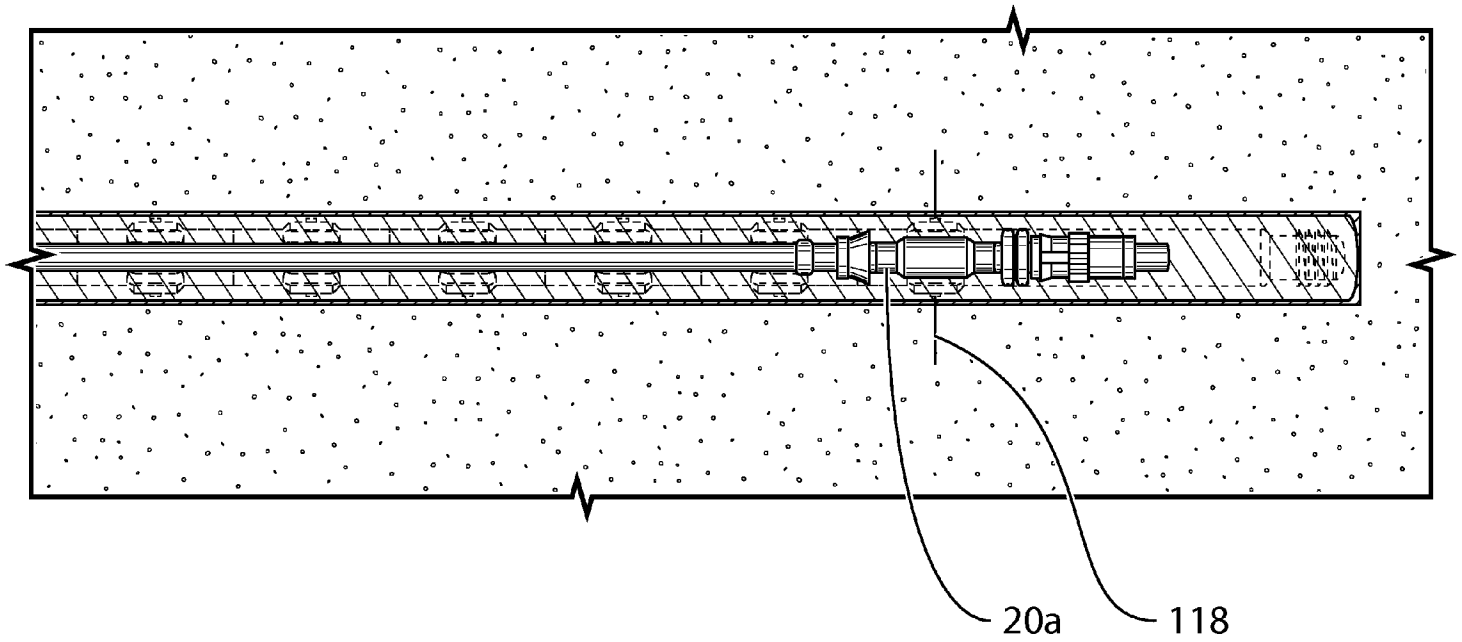
Figure 1I:
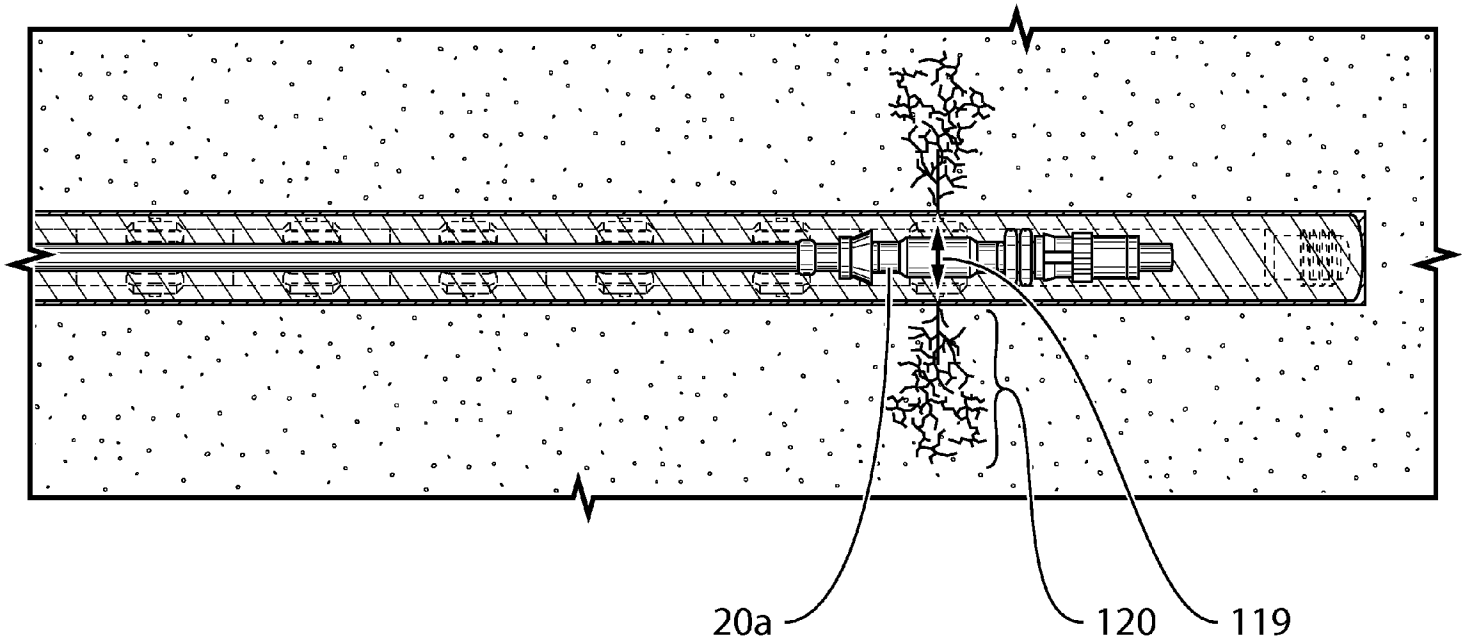
Figure 1J:
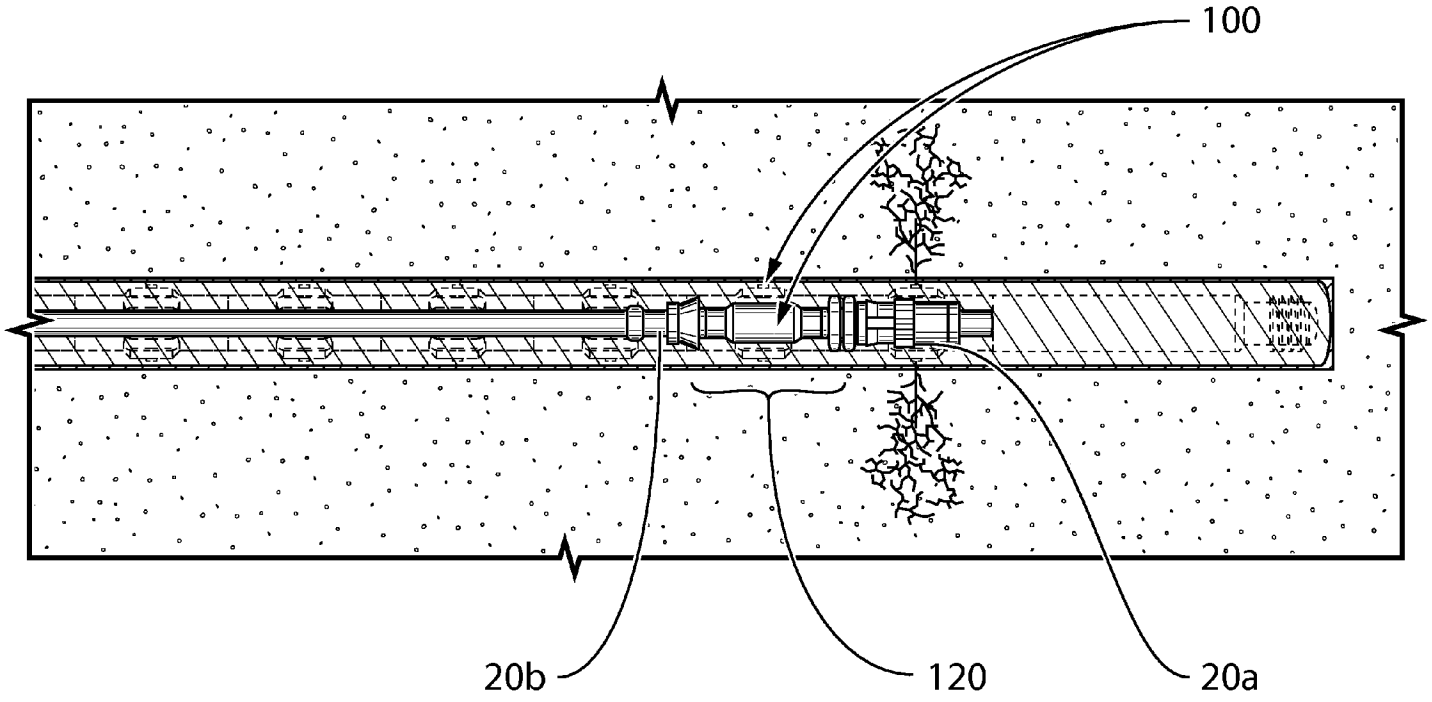
Figure 1K:
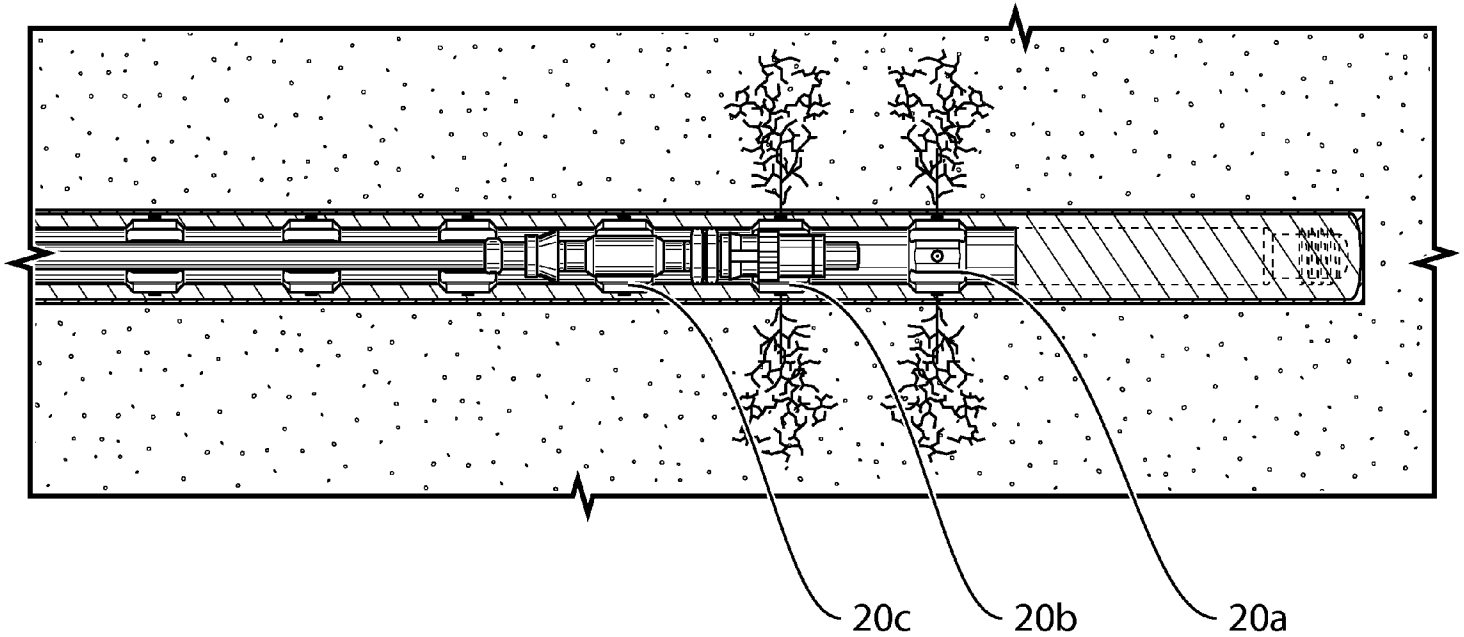
Figure 1I:
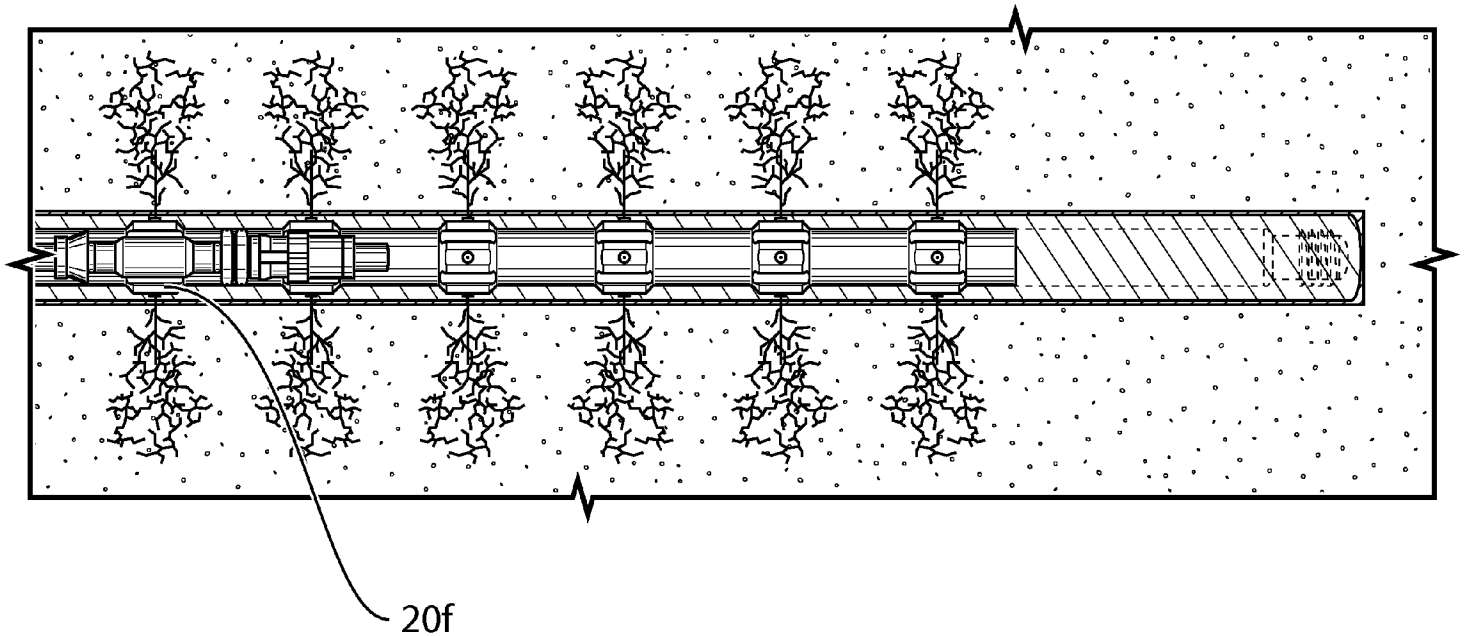
Figure 1M:
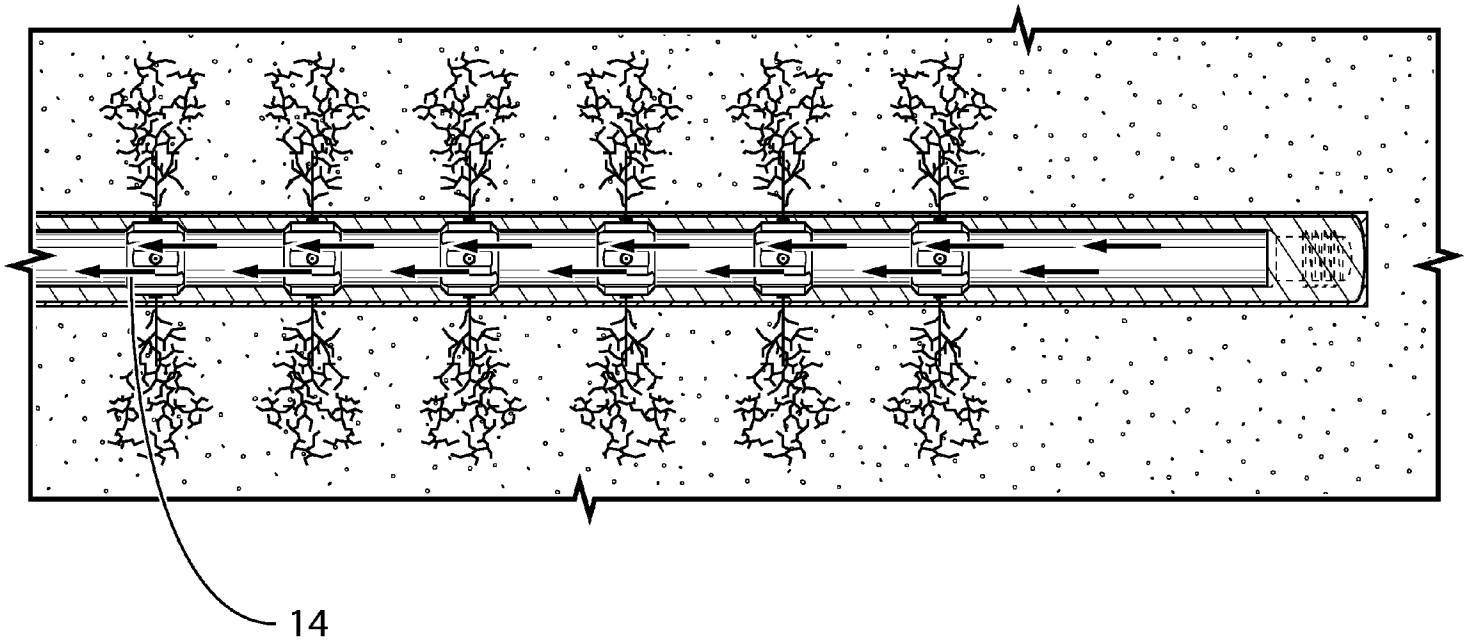

Completion of the well requires, in this example, a coil fracturing system where a treatment string 114 is tripped down the production casing 16 (FIG. 1*g*). The treatment string 114 is located so as to position an isolation device in a manner which fluidly isolates a given interval 116 of the production casing. In this instance a packer/cup or cup/cup type straddle system is employed to isolate the grouping of four insert assemblies 100 located on a first collar 20*a*, referred to herein as the first stage. A treatment fluid is then injected under pressure into the isolated interval 116 of the collar. When a threshold pressure is reached, the insert assembly's core should disengage, or release, from the insert and eject outwardly from its port as a projectile and impact the adjacent subterranean formation to initiate the fracing process with initial cracks (indicated by 118 in FIG. 1*h*). The fracing process continues in the vicinity of collar 20*a* as the pressurized treatment fluid (indicated by 119 in FIG. 1*i*) exits the ports (post core ejection) and through the initial cracks to propogate further cracking 120.

Once the fracing process is completed for the first stage, the pressure on the treatment fluid is released and the treatment string is moved back to created an isolated interval 120 straddling the insert assemblies 100 of the next (second) collar 20*b* (FIG. 1*j*), and the above fracing process is followed for this second stage. This process is repeated for each stage (20C in FIG. 1*k*) until the last stage (20*f* in FIG. 1L) is completed and the treatment string is rigged out. The well is then ready for production by flowing the target fluid (14 in FIG. 1*m*) from the formation through the many ports and up the production casing to surface.

Some of the many advantages of the present invention may now be better understood.

When the ejected cores travel as projectiles at high speed in a bullet-like manner outwardly from their ports to contribute to the fracture of a formation by initiating cracks therein. It is believed that impacts on the subterranean formation are creating crack initiation points and are penetrating formations to varying depths (depending on rock strength) which is permitting the pressurized treatment (frac) fluid to penetrate more deeply into the formation than with prior art methods, including those using broken fluid barrier devices. It is thought that the ejected core propogates cracks in the wellbore which the pressurized fluid "follows". Surface tests have resulted in core penetrations of substantial depth, in the range of 2 to 6 inches (about 51 to 152 mm)

The ejected core is thought to be effective in crack propogation, but without the violent jarring action of prior art downhole "guns" or explosives that can cause damage in the perforation area, particularly to the wellbore's cement sheath which could result in unwanted leaks and/or communication with other intervals of interest within the wellbore.

Another advantage is that the hole in the insert's lid equalizes the pressures exterior to the core, namely the pressure in the insert's chamber is the same as the annulus pressure outside of the lid. Hence, the lid thickness remains fairly consistant regardless of well depth, and so the core ejection force to open the lid remains fairly low even at greater well depths. This configuration allows this invention to operate at True Vertical Depths (TVD) greater than 1200 m (about 3960 ft). In contrast, prior art devices, such as burst port or disk technology, seek to isolate their disks from the annulus and its pressure with barriers that must be made thicker the deeper these devices are run into a well, and thus have difficulty or can not operate at TVDs over 1200 m.

Further, any gel that escapes from the insert through the lid hole into the annulus helps prevent cement in that area from setting. This is thought to permit the ejected core and subsequent pressurized frac fluid to apply more force directly into the formation, rather than being impeded by a sealing external barrier or cement "wall" that has set as in prior art methods.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For instance, it is possible to alter the length of the core, such as increasing the core's length between its exterior and interior surfaces 56, 58, so as to fit and function in collars having deeper fins 26*a* and ports 28*a* as illustrated in FIGS. 7*a* and 7*b*, and/or different diameters of ports, and the like. Whereas the insert shown in FIGS. 4*a*-4*e* is configured for the collar in FIGS. 3*a*-3*c* which fits into a "4.5 inch" casing, a longer insert is provided for the collar of FIGS. 7*a*-7*b* which fits a "5.5 inch" (diameter) casing.

We claim:

1. An assembly for perforating a subterranean formation for use in a tubular member having at least one port, the tubular member being insertable in a wellbore intersecting the subterranean formation and receives a treatment fluid under pressure, the assembly comprising:

an insert having a body for sealing engagement with the port, the body including a core having a first mode wherein the core prevents fluid passage through the body and a second mode wherein the core disengages from the body upon the treatment fluid reaching a threshold pressure and ejects from the body as a projectile and fractures the formation with the pressurized treatment fluid exiting the port; and a debris shield mountable in the port, spaced from the core, wherein the shield and insert define a chamber therewithin, and wherein the shield includes at least one hole in the shield prior to the core disengaging from the body.

2. The assembly of claim 1 wherein the chamber includes a substance for resisting entry of a wellbore fluid thereinto through the hole.

3. The assembly of claim 2 wherein the wellbore fluid comprises a cement and the substance comprises a gel adapted to prevent the cement from setting.

4. The assembly of claim 1 wherein the core forms a generally planer disk-shaped projectile upon disengaging from the insert.

5. The assembly of claim 1 wherein the core forms a generally cone-shaped projectile upon disengaging from the insert.

6. The assembly of claim 1 further comprises a resilient clamp for engaging the port to retain the shield on the tubular member adjacent the insert.

7. The assembly of claim 1 wherein an end of the insert body opposite the core is shaped to receive a tool for inserting the insert into the port.

8. The assembly of claim 7 wherein the shape is generally triangular with rounded corners.

9. The assembly of claim 1 wherein the core is formed integrally with the insert body at one end thereof and includes a threshold fluid pressure defining means.

10. The assembly of claim 9 wherein the threshold fluid pressure defining means comprises a groove of given dimensions delineating the periphery of the core.

11. The assembly of claim 10 wherein said given dimensions define a generally v-shaped groove in cross-section.

12. A downhole apparatus for perforating a subterranean formation comprising:

a tubular member insertable in a wellbore intersecting the subterranean formation for receiving a treatment fluid under pressure;

at least one port in the tubular member; and, an insert sealingly engaged with the port, the insert including a core having a first mode wherein the core prevents fluid passage through the insert and a second mode wherein the core disengages from the insert upon the treatment fluid reaching a threshold pressure and ejects from the insert as a projectile and fractures the formation with the pressurized treatment fluid exiting the port; and a debris shield spaced from the core wherein the shield and insert define a chamber therewithin, wherein the shield is perforated prior to the core disengaging from the body, to provide a means of equalizing pressure between the chamber and an annulus formed between the tubular member and the wellbore.

13. The apparatus of claim 9 wherein the chamber includes a substance for resisting entry of a wellbore fluid thereinto through the hole.

14. The apparatus of claim 13 wherein at least some of the substance is adapted to exit the hole and prevent the wellbore fluid from setting in the port.

15. The apparatus of claim 9 wherein the port is located in a radially outwardly extending fin portion of the tubular member where an annulus formed between the tubular member and the wellbore is reduced adjacent the fin portion.

* * * * *